US011028698B1

(12) United States Patent
Jones et al.

(10) Patent No.: US 11,028,698 B1
(45) Date of Patent: Jun. 8, 2021

(54) CERAMIC RADIAL TURBINE

(71) Applicant: Florida Turbine Technologies, Inc., Jupiter, FL (US)

(72) Inventors: Russell B Jones, North Palm Beach, FL (US); Edwin L Kite, Stuart, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 56 days.

(21) Appl. No.: 16/446,970

(22) Filed: Jun. 20, 2019

Related U.S. Application Data

(60) Provisional application No. 62/688,819, filed on Jun. 22, 2018.

(51) Int. Cl.

| | |
|---|---|
| ***F01D 5/02*** | (2006.01) |
| ***F01D 5/04*** | (2006.01) |
| ***F04D 29/26*** | (2006.01) |
| ***F04D 29/28*** | (2006.01) |
| ***F01D 5/28*** | (2006.01) |

(52) U.S. Cl.
CPC ..... *F01D 5/025* (2013.01); *F01D 5/046* (2013.01); *F01D 5/048* (2013.01); *F01D 5/284* (2013.01); *F04D 29/266* (2013.01); *F04D 29/284* (2013.01); *F05D 2220/32* (2013.01); *F05D 2240/24* (2013.01); *F05D 2260/20* (2013.01); *F05D 2260/31* (2013.01); *F05D 2300/20* (2013.01)

(58) Field of Classification Search
CPC ..... F01D 5/025; F01D 5/048; F01D 5/284; F04D 29/284; F04D 29/266; F05D 2240/24; F05D 2260/31
See application file for complete search history.

(56) References Cited

U.S. PATENT DOCUMENTS 4,786,238 A * 11/1988 Glaser ..... F01D 25/125 415/175
4,915,589 A * 4/1990 Gessler ..... F01D 5/025 415/217.1
5,020,932 A * 6/1991 Boyd ..... F01D 5/025 403/289
5,169,297 A * 12/1992 Mizuno ..... F01D 5/025 416/244 A

FOREIGN PATENT DOCUMENTS

JP 58220901 A * 12/1983 ..... F01D 5/025

* cited by examiner

*Primary Examiner* — Ninh H. Nguyen
(74) *Attorney, Agent, or Firm* — Christopher & Weisberg, P.A.

(57) ABSTRACT

A small gas turbine engine with a ceramic turbine to allow for higher turbine inlet temperatures, where a metallic compressor is secured to a ceramic shaft extending from a ceramic turbine to form a single piece ceramic shaft and turbine, where a threaded nut secures a split ring retainer on the compressor end of the ceramic shaft. A hollow thrust runner is compressed between the compressor disk and the turbine disk by the threaded nut to secure rotor together. A centering spring forms a tight fit between the metallic thrust runner and the ceramic shaft on the turbine side.

6 Claims, 3 Drawing Sheets

CERAMIC RADIAL TURBINE

CROSS-REFERENCE TO RELATED APPLICATIONS

This Application claims the benefit to U.S. Provisional Application 62/688,819 filed on Jun. 22, 2018 and entitled CERAMIC RADIAL TURBINE.

GOVERNMENT LICENSE RIGHTS

None.

BACKGROUND OF THE INVENTION

Field of the Invention

The present invention relates generally to a gas turbine engine, and more specifically to a small gas turbine engine for a Unmanned Aerial Vehicle (UAV) with a high turbine inlet temperature.

Description of the Related Art Including Information Disclosed Under 37 CFR 1.97 and 1.98

In a gas turbine engine, a gas turbine drives a compressor to supply compressed air to a combustor where a fuel is burned to produce a hot gas flow that is passed through the gas turbine to drive the compressor and a fan to propel the vehicle. The efficiency of the engine can be increased by passing a higher temperature gas flow into the turbine. However, the turbine inlet temperature is limited to what the turbine materials can withstand. Nickel super alloys are typically used as a material for the gas turbine. Turbine airfoil cooling is performed to allow for even higher turbine inlet temperatures. However, for a small gas turbine engine of the type used to power a UAV, the airfoils of the gas turbine are too small for cooling passages.

BRIEF SUMMARY OF THE INVENTION

A small gas turbine engine for a UAV, where the engine includes a radial flow gas turbine and rotor shaft both made as a single piece and from a ceramic material so that an increased firing temperature can be used that will allow for a power to weight ratio of the engine to be more than double that from an all-metal gas turbine engine.

A metallic shaft thrust runner forms an annular cooling passage with the ceramic shaft to pass cooling air. A compliant spacer star centering ring is located adjacent to the radial flow gas turbine between the ceramic shaft and the metallic shaft thrust runner.

DETAILED DESCRIPTION OF THE INVENTION

The present invention is a small gas turbine engine used to power an unmanned aero vehicle (UAV) in which the gas turbine is a radial flow gas turbine made of a ceramic material along with a ceramic shaft connected to a metal compressor, where the ceramic radial flow gas turbine is without cooling and the ceramic shaft includes an metal outer sleeve that forms a cooling passage for the turbine shaft. The ceramic radial flow turbine and the ceramic shaft are formed as a single piece. The ceramic radial turbine and ceramic shaft of the present invention will allow for a combustor firing temperature (T4) of around 2,400 degrees F. which will more than double the power to weight capability of the engine over a prior art all metal gas turbine engine.

The small gas turbine engine includes a radial flow compressor 11 and a radial flow gas turbine 12 both supported by air foil bearings. A reverse flow combustor is integrated within the structure of a high effectiveness recuperator. The engine powers a high speed electric generator that is also supported on air foil bearings. The electric generator can be directly driven by the shaft of the engine, or can be driven through an oil-less gearbox for shaft drive applications. Use of the integrated recuperator with this engine will allow for a compressor pressure ratio of 5 to 6 which will avoid the historic issues of environmental effects causing ceramic surface degradation seen in APU (Auxiliary Power Unit) applications and stationary industrial gas turbines.

The radial flow gas turbine 12 and ceramic shaft 13 are both formed as a single piece and from $Si_3N_4$ monolithic ceramic material. With this monolithic ceramic material, it is feasible to increase the relative rotor inlet temperature to 2,250 degrees F. equivalent to around 2,400 degrees F. firing temperature (T4).

Figure 1:
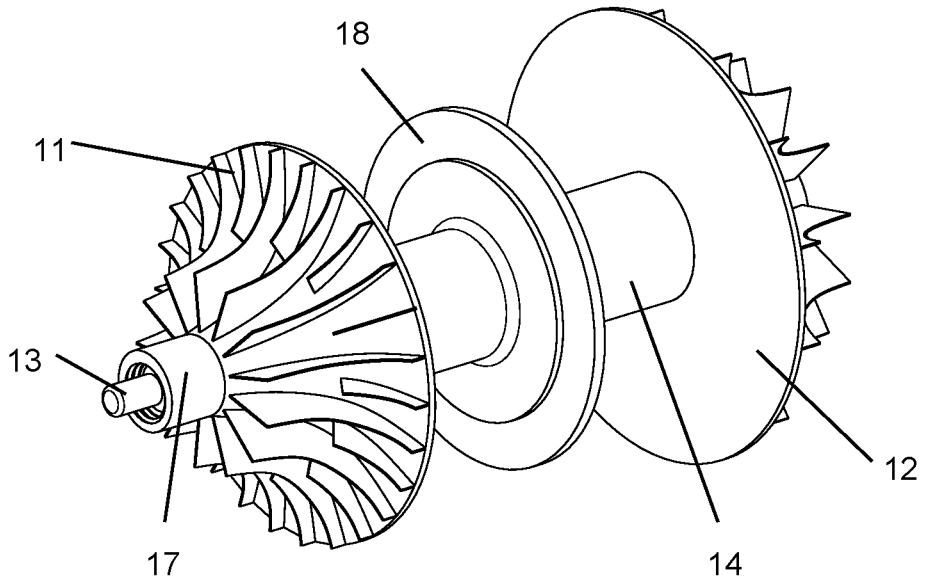
FIG. 1 shows an isometric view of a rotor with a compressor and a turbine of the present invention.
Figure 2:
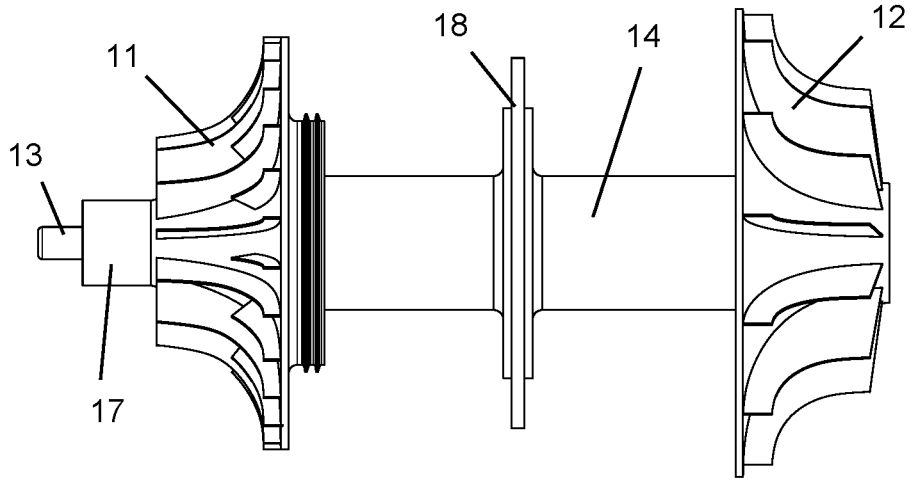
FIG. 2 shows a side view of the rotor of FIG. 1.
Figure 3:
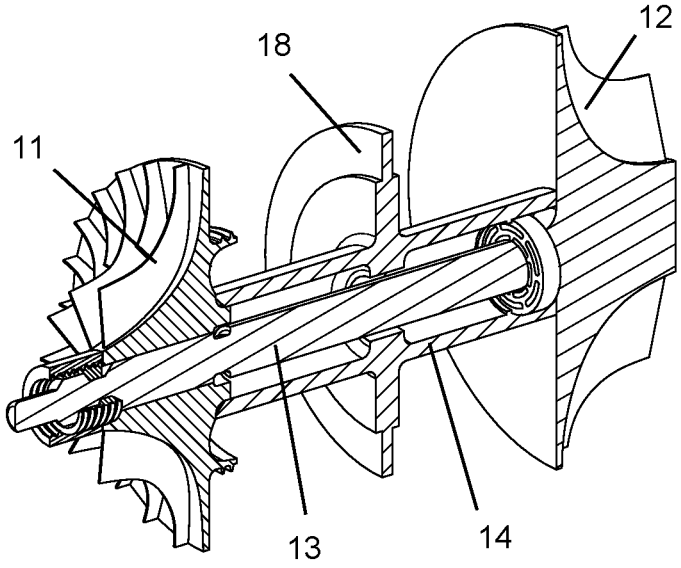
FIG. 3 shows a cross section angled view of the rotor of FIG. 1.
Figure 4:
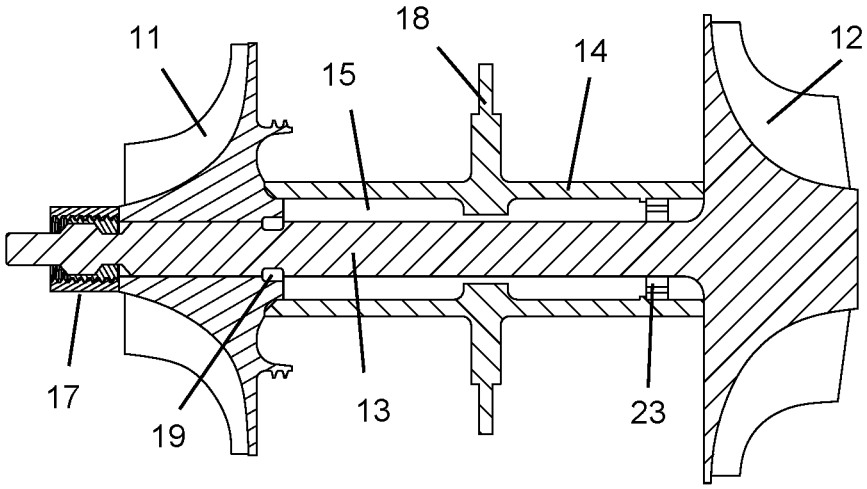
FIG. 4 shows a cross section side view of the rotor of FIG. 1.

FIG. 1 shows an assembled rotor of the present invention with a metal compressor 11 and a ceramic turbine 12, a threaded nut 17 that secures the front side of the compressor 11 to the shaft 13, and a thrust runner 14 with a thrust bearing disk 18 for air foil thrust bearings to make contact with. FIG. 2 shows a side view of the assembled rotor with the compressor 11 and the turbine 13 with the thrust runner 14 in-between the two disks 11 and 13. FIG. 3 shows a cross section view of the rotor with the ceramic shaft 13 extending from the ceramic turbine 13 through the thrust runner 14 to the metallic compressor 11. FIG. 4 shows a cross section side view of the rotor from FIG. 3. The threaded retention nut 17 is secured over the split ring retainer 21 (FIG. 6) to secure the compressor 11 to the shaft 13. Torque keys 19 in FIG. 4 are used to provide torque between the shaft 13 and the compressor disk 11.

Figure 5:
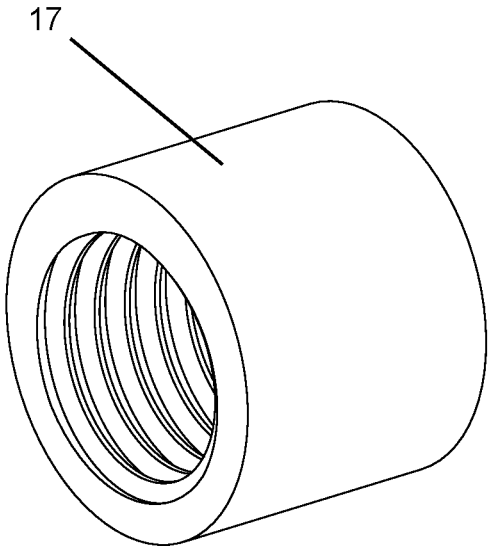
FIG. 5 shows an isometric view of a nut used to secure the compressor disk to the shaft of the present invention.
Figure 6:
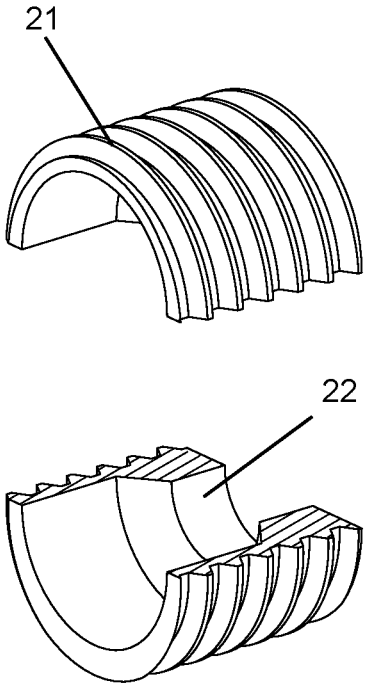
FIG. 6 shows an unassembled view of a split ring collet used to secure the compressor disk to the shaft of the present invention.

The radial flow compressor 11 made from a non-ceramic material is secured to the ceramic shaft 13 using the threaded split ring retainer 21 held in place by the single piece threaded retention nut 17. At the compressor end, the ceramic shaft 13 is ground with a double conical recess where the threaded split ring retainer 21 is inserted and compressed by a retention nut 17. Small flats are ground on the ceramic shaft 13 that interface with corresponding flats on the interior of a split retention ring 21. FIG. 5 shows the retention nut 17. FIG. 6 shows the two-piece threaded split ring retainer 21 with an inner annular protecting part 22 that fits within double conical recess formed on the outer surface of the shaft 13 to retain the compressor 11 to the ceramic shaft 13. The inner surface of the retention nut 17 and the outer surface of the split ring retainer 21 have threads that engage to secure the retention nut over the split ring retainer 23. With this arrangement, the high temperature turbine rotor is thermally isolated from the bearing shaft runner with the interrupted conduction path of the compliant spacer star of the turbine side of the ceramic shaft 13. The temperature drop in the ceramic shaft 13 is allowed to utilize the entire shaft length to the compressor 11 end and will minimize the shaft thermal stresses, and reduce the heat load to the bearing runner.

Figure 7:
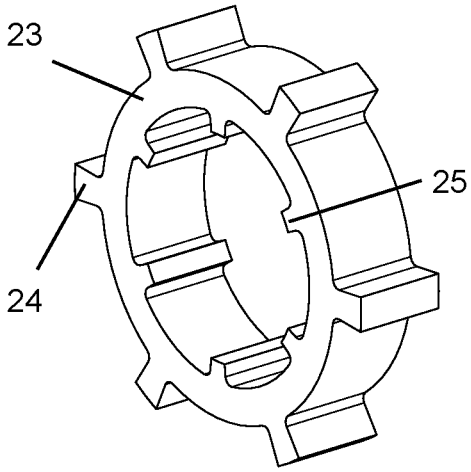
FIG. 7 shows an isometric view of a centering springs used to connect a metal thrust runner to a ceramic shaft of the present invention.

On the ceramic turbine shaft 13, a metallic shaft runner 14 is positioned with an interference fit compliant spacer star centering ring 23 situated between the shaft runner 14 and the ceramic turbine shaft 13. The centering ring 23 provides for a tight fit between the metal thrust runner 14 and the ceramic shaft 13 so that a tight fit is formed even when the metallic thrust runner 14 expands with respect to the ceramic shaft 13 under high temperatures. An annular cooling flow passage 15 is formed between the ceramic shaft 13 and the metallic thrust runner 14 in which cooling air is passed through the annular passage 15 and through the compliant spacer star centering ring 23. FIG. 7 shows an isometric view of the compliant spacer star centering spring 23 with radial outward projections 24 abutting an inner surface of the metallic shaft runner 14 and radial inward projections 25 abutting an outer surface of the ceramic shaft 13. The radial outward projections 24 are offset from the radial inward projections 25 to produce a spring effect between the metallic thrust runner 14 and the ceramic shaft 13.

The invention claimed is:

1. A rotor for a small gas turbine engine comprising:

a metallic compressor;

a ceramic turbine with a ceramic shaft forming a single piece ceramic shaft and ceramic turbine;

a metallic thrust runner secured between the metallic compressor and the ceramic turbine with the ceramic shaft extending within the metallic thrust runner and forming a cooling air passage;

a split ring retainer and a threaded nut secured over the ceramic shaft to secure the metallic compressor to the ceramic shaft; and a centering spring secured between an inner surface of the metallic thrust runner and an outer surface of the ceramic shaft near to the ceramic turbine, the centering spring includes a plurality of radial outward projections and a plurality of radial inward projections offset to produce a spring effect between the metallic thrust runner and the ceramic shaft.

2. The rotor for the small gas turbine engine of claim 1, wherein the ceramic shaft on the compressor end has a recess on an outer surface; and the split ring retainer has an inner projecting piece that fits within the recess of the ceramic shaft.

3. The rotor for the small gas turbine engine of claim 1, wherein the split ring retainer includes threads on an outer surface; and the retainer nut includes threads on an inner surface to engage the threads on the split ring retainer.

4. The rotor for the small gas turbine engine of claim 1, wherein the metallic thrust runner includes an annular thrust bearing disk extending outward.

5. The rotor for the small gas turbine engine of claim 1, wherein the threaded nut retains the split ring retainer in place on the ceramic shaft and applies axial force to the compressor to compress the metallic thrust runner between the compressor and the turbine.

6. A rotor for a small gas turbine engine comprising:

a metallic compressor;

a ceramic turbine with a ceramic shaft forming a single piece ceramic shaft and ceramic turbine;

a metallic thrust runner secured between the metallic compressor and the ceramic turbine with the ceramic shaft extending within the metallic thrust runner and forming a cooling air passage;

a split ring retainer and a threaded nut secured over the ceramic shaft to secure the metallic compressor to the ceramic shaft; and a plurality of torque keys between an inner surface of a compressor disk of the metallic compressor and an outer surface of the ceramic shaft provide a torque transfer from the ceramic shaft to the compressor disk.

* * * * *